US010168062B2

(12) United States Patent
Lu

(10) Patent No.: US 10,168,062 B2
(45) Date of Patent: Jan. 1, 2019

(54) COLD WIND TABLE CABINET

(71) Applicant: Dong Guan Song Wei Electric Technology Co., Ltd., Dongguan (CN)

(72) Inventor: Weilin Lu, Dongguan (CN)

(73) Assignee: DONG GUAN SONG WEI ELECTRIC TECHNOLOGY CO., LTD., Dongguan, Guangdong (CN)

( * ) Notice: Subject to any disclaimer, the term of this patent is extended or adjusted under 35 U.S.C. 154(b) by 99 days.

(21) Appl. No.: 15/220,369

(22) Filed: Jul. 26, 2016

(65) Prior Publication Data

US 2018/0031255 A1 Feb. 1, 2018

(51) Int. Cl.

| | |
|---|---|
| ***F25D 23/12*** | (2006.01) |
| ***F24F 5/00*** | (2006.01) |
| ***F24F 11/52*** | (2018.01) |
| ***A47B 81/00*** | (2006.01) |
| ***F24F 13/20*** | (2006.01) |

(52) U.S. Cl.

CPC ..... *F24F 5/0096* (2013.01); *A47B 81/00* (2013.01); *F24F 5/0042* (2013.01); *F24F 11/52* (2018.01); *F24F 13/20* (2013.01); *F24F 2221/10* (2013.01)

(58) Field of Classification Search

CPC ..... F24F 5/0096; F24F 5/0042; F24F 2011/0091; F24F 2221/10; F24F 13/0604; F25B 2321/00; F25B 2321/02; F25B 2321/023; A47B 83/045; H01L 35/32

USPC ..... 62/3.2, 3.4, 261

See application file for complete search history.

(56) References Cited

U.S. PATENT DOCUMENTS

| | | | | |
|---|---|---|---|---|
| 4,457,140 A * | 7/1984 | Rastelli | F25D 17/06 312/236 |
| 2007/0119187 A1* | 5/2007 | Kitchens | F25B 21/02 62/3.6 |
| 2008/0163628 A1* | 7/2008 | Lilke | F25B 21/02 62/3.6 |

* cited by examiner

*Primary Examiner* — Joseph Trpisovsky
(74) *Attorney, Agent, or Firm* — Leong C. Lei

(57) ABSTRACT

A cold wind table cabinet includes a main body, inside which a refrigeration device is configured. The refrigeration device includes a housing, blower, and refrigeration box, where refrigeration components are installed inside the refrigeration box. A blower air inlet is in communication with a housing air outlet, a refrigeration air inlet faces and is in communication with a blower air outlet, and a refrigeration air outlet a housing air outlet. Whereby, the present invention allows the table cabinet to have the function of selecting cold wind or natural wind to blow out, and especially, eliminates the configurations of an air fan or air pipe.

8 Claims, 7 Drawing Sheets

COLD WIND TABLE CABINET

(A) TECHNICAL FIELD OF THE INVENTION

The present invention relates to a table cabinet, and more particularly to a cold wind table cabinet.

(B) DESCRIPTION OF THE PRIOR ART

Nowadays, air conditioners, electric fans, and etc are generally used for cooling in a hot weather. As commonly used products in home, office or other places, air conditioners or electric fans have the defect of only one single function, incapable of using as table cabinets or other items; air conditioners and electric fans are always left unused in home when there is no need for cooling, which occupies home space, resulting in a waste of space. In addition, the air conditioners, electric fans, and etc of the current technology are larger in volume, and some of them are moved inconveniently and have poor application flexibility.

SUMMARY OF THE INVENTION

To improve a table cabinet, and allow it to have more functions, the present invention is proposed.

The object of the present invention is to provide a cold wind table cabinet, realizing a multi-functional use such as table cabinet use and refrigeration by integrating a refrigeration device into a table cabinet. In particular, the integrated structure is compact and reasonable; the table cabinet has the mobility, and can be flexibly used in various occasions.

To achieve the object mentioned above, the present invention proposes a cold wind table cabinet, including a main body having a table top, a refrigeration device is configured in the main body below the table top, the refrigeration device including a housing, and a blower and refrigeration box installed inside the housing, a housing air inlet and housing air outlet being respectively opened on the housing, the blower having a blower air inlet and blower air outlet, a refrigeration air inlet and refrigeration air outlet being respectively opened on the refrigeration box, refrigeration components being installed inside the refrigeration box, the blower air inlet being in communication with the housing air inlet, the refrigeration inlet facing and being in communication with the blower air outlet, and the refrigeration air outlet the housing air outlet.

Preferably, the refrigeration device further includes a control board, the blower and refrigeration components are respectively connected to the control board, an operation panel adapted to control the blower and refrigeration components is configured on a surface of the main body, the operation panel is in connection with the control board, and a control switch adapted to control on and off of the refrigeration components is at least configured on the control board.

Preferably, a push button adapted to switch between natural wind and cold wind is configured on the operation panel.

Preferably, the blower air outlet, refrigeration air inlet, refrigeration air outlet and housing air outlet are arranged in sequence along the same straight line.

Preferably, the blower air outlet is opened on a front side face of the blower, the refrigeration air inlet a rear side face of the refrigeration box, the refrigeration air outlet a front side face of the refrigeration box, and the housing air outlet a front side face of the housing.

Preferably, the refrigeration components comprises a refrigeration sheet, and first and second cooling sheets, the refrigeration sheet has a cooling face and heating face, the first cooling sheet is in contact with the heating face, the second cooling sheet the cooling face, and the first cooling sheet is exposed outside of the refrigeration box.

Preferably, a mounting hole for the installment of the refrigeration components is opened on the refrigeration box, the refrigeration components are installed inside the refrigeration box correspondingly to the mounting hole; a heat insulation cotton, positioning piece, engagement sheet and sealing ring are installed in sequence between the first and second cooling sheets, the heat insulation cotton is installed on a side face of the first cooling sheet facing the cooling sheet, a first through hole is opened on the heat insulation cotton, a second through hole facing exactly the first through hole the position piece, the refrigeration sheet is positioned inside the first, second through holes; a first peripheral positioning groove is indented on a side face of the positioning piece facing the engagement sheet, the first peripheral positioning groove is configured around a periphery of the second through hole, the engagement sheet is a frame structure matching with the first peripheral position groove, the engagement sheet is engaged with the first peripheral positioning groove, a second peripheral positioning groove is indented on a side face of the engagement sheet facing the second cooling sheet, the sealing ring is embedded in the second peripheral positioning groove, the second cooling sheet is locked to the positioning piece, and the engagement sheet, sealing ring are sandwiched and positioned between the second cooling sheet and positioning piece.

Preferably, the first cooling sheet is sealed to the mounting hole and fixed on the refrigeration box, a cooling fan blowing toward the first cooling sheet is configured outside the first cooling sheet; at least two limiting plates opposite to each other are configured on an inner wall of the refrigeration box correspondingly to a periphery of the mounting hole, the heat insulation cotton, refrigeration sheet, positioning piece, engagement sheet, sealing ring and second cooling sheet are positioned inside the mounting hole and limited between the two limiting plates.

Preferably, the present invention further includes a water container for the collection of condensed water droplets inside the refrigeration box, where the water container is installed on a bottom of the housing directly or configured on a bottom of the main body, with the water container being in communication with an inside of the refrigeration box through an aqueduct.

Preferably, the housing includes a bottom case and upper cover, the blower and refrigeration box are positioned inside the bottom case, the upper cover is covered on an opening of a upper end of the bottom case; the blower and refrigeration box are installed on a bottom of the upper cover or inside the bottom case of the housing, and the upper cover is installed on a bottom of the table top.

The present invention has obvious advantages and benefits. Specifically, the technical solution mentioned above mainly integrates the refrigeration device into the table cabinet, realizing the multiple functions of table cabinet use and refrigeration. Upon use cold wind (or natural wind by turning off the refrigeration device) is blown out from the housing air outlet, allowing a user to feel cool air flow. Therefore, the present invention is very practical. More particularly, all the air inlets and outlets of the refrigeration device are specially arranged, eliminating the design of a air fan, air tube and etc, saving design space and facilitating the compact design of the refrigeration device, allowing the refrigeration device to occupy smaller space on the table cabinet and the overall structure of the cold wind table cabinet to be more compact and reasonable, thereby facilitating controlling the production cost of the cold wind table cabinet.

According to the present invention, the refrigeration box, and the structures of the design of the mutual assembly positioning relationship in the refrigeration device are rather unique, allowing the assembly to be convenient and quick, and the positioning to be stable and dependable, compact and reasonable. Especially, the configurations of the first cooling sheet, cooling fan and second cooling sheet facilitate speeding up the heat absorption of the refrigeration components and improving the cooling performance. Therefore, the present invention is good in refrigeration effect, smaller in running energy consumption and more environmentally friendly.

DETAILED DESCRIPTION OF THE PREFERRED EMBODIMENTS

Referring to FIGS. 1 to 7, they show a specific structure of a preferred embodiment according to the present invention.

Figure 1:
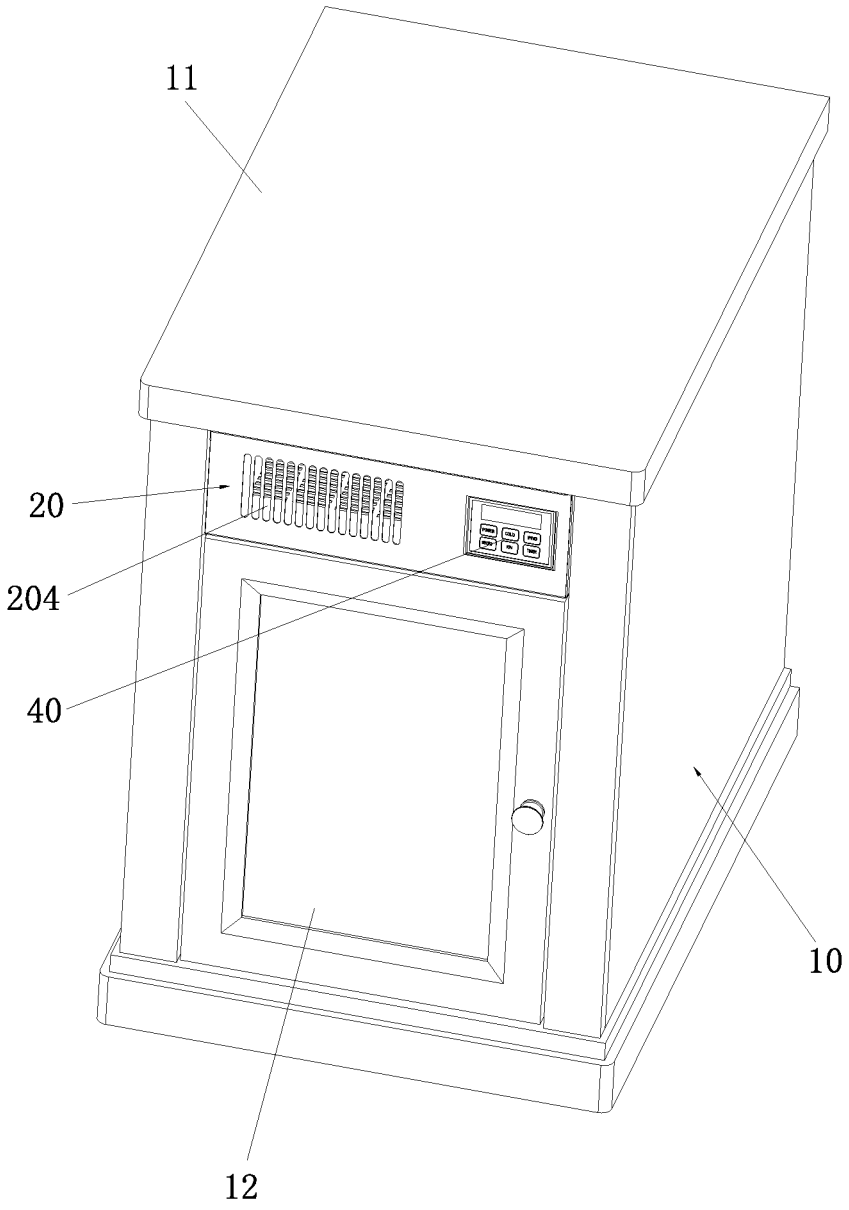
FIG. 1 is a perspective view of a preferred embodiment of the present invention.
Figure 2:
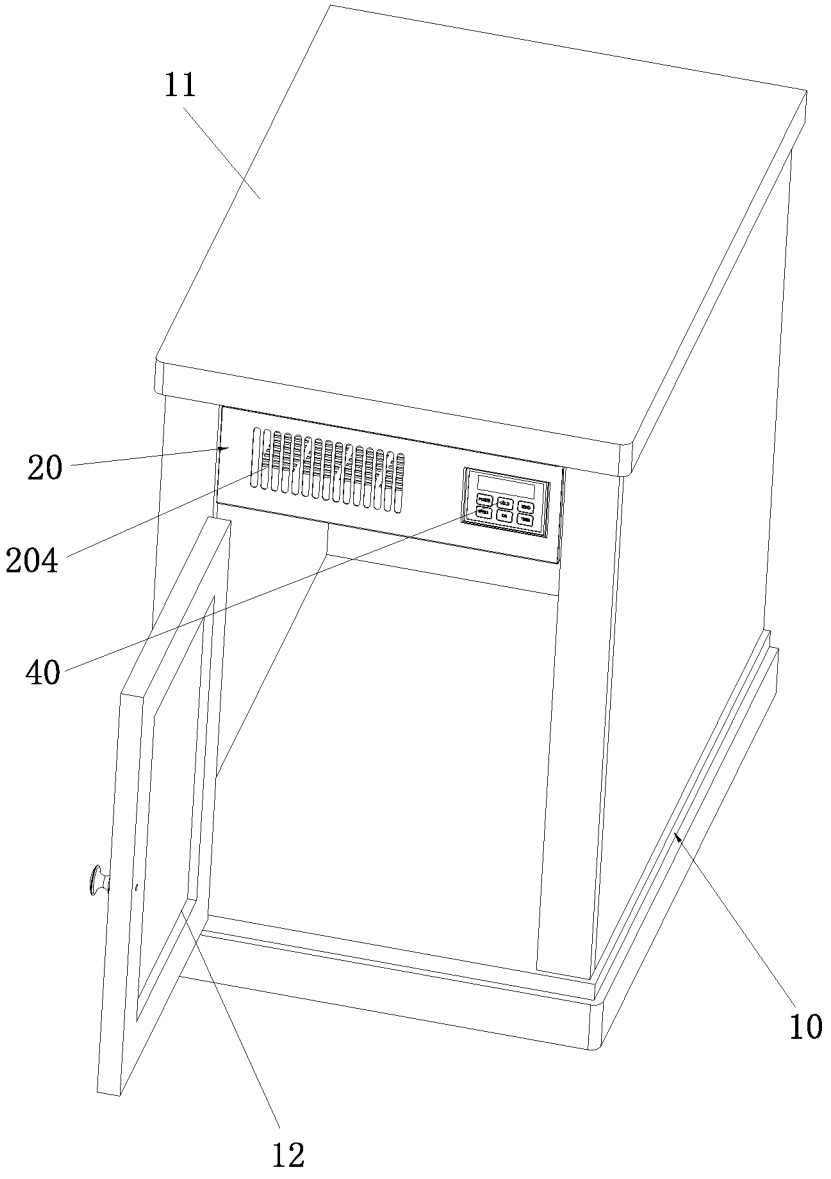
FIG. 2 is a perspective view of the embodiment of the present invention viewing from another angle.

A cold wind table cabinet, as FIGS. 1 and 2, includes a main body 10 having a table top 11, below which a refrigeration device 20 is configured.

The main body 10 may be made of wood, plastics or metal; among the four side faces of the main body 10, the front side face thereof is configured with a retractable door 12, and the other three side faces thereof are sealed. Naturally, there is no limitation to the specific structure of the main body here; the main body itself may be any other suitable structure.

Figure 3:
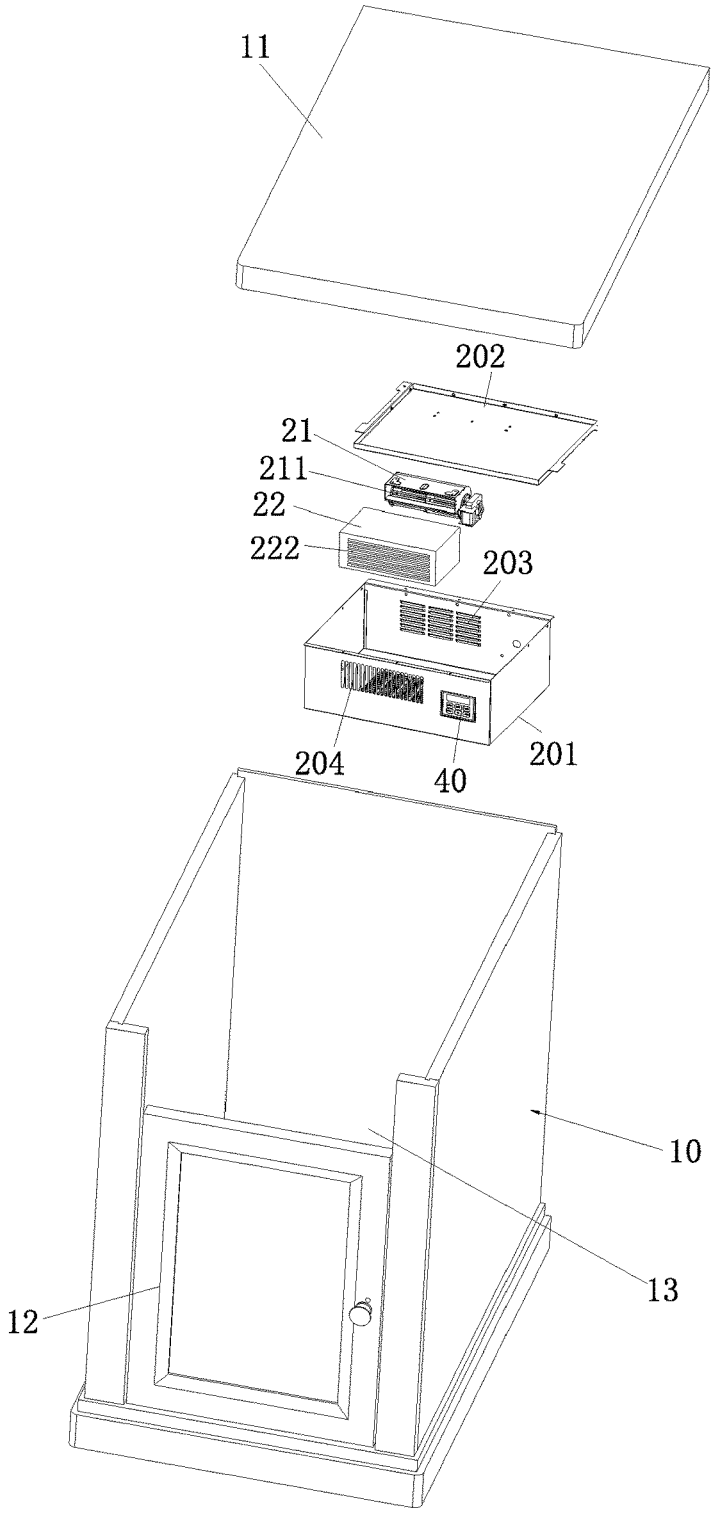
FIG. 3 is an exploded view of the embodiment of the present invention.
Figure 4:
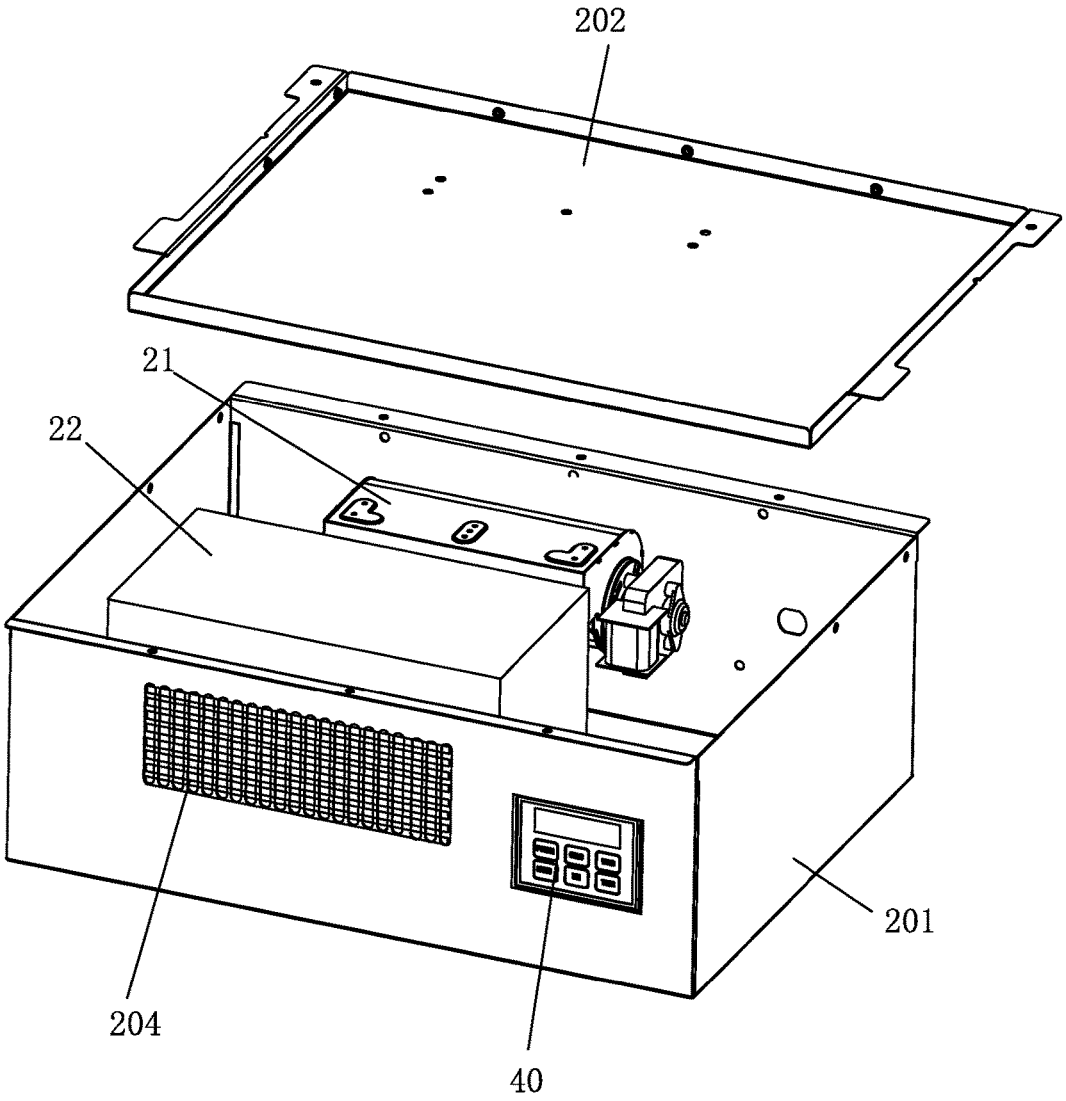
FIG. 4 is an exploded view of a refrigeration device of the embodiment according to the present invention.
Figure 5:
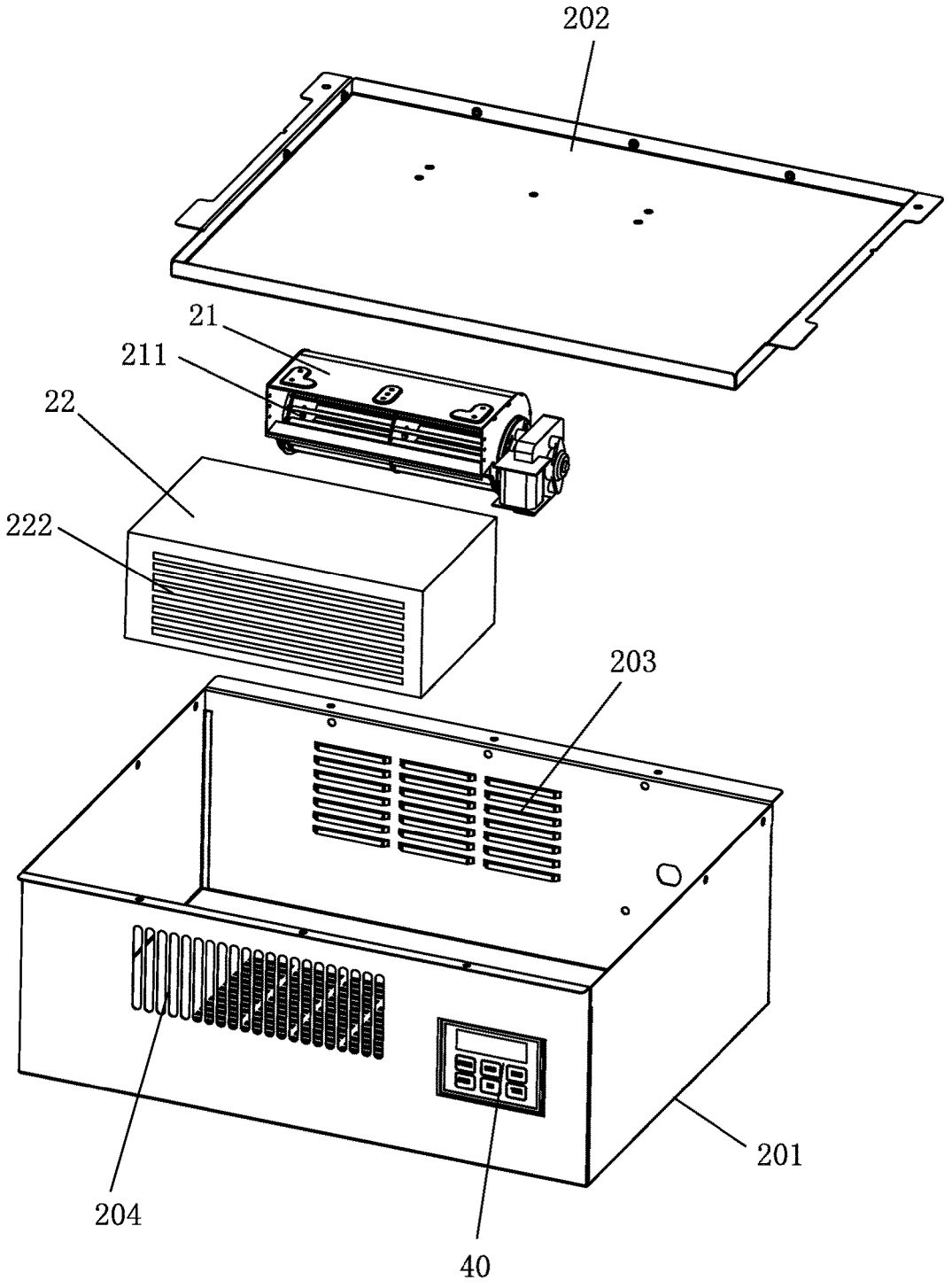
FIG. 5 is another exploded view of a refrigeration device of the embodiment according to the present invention.

The refrigeration device 20, as FIGS. 3 to 5 show, includes a housing and a blower 21 and refrigeration box 22 installed therein. In the embodiment, the housing includes a bottom case 201 and upper cover 202, where the blower 21 and refrigeration box 22 are positioned inside the bottom case 201, and the upper cover 202 is covered on the opening at the upper end of the bottom case 201. Furthermore, the blower 21 and refrigeration box 22 are installed on the bottom part of the upper cover 202; the blower 21 may also be integrated with the refrigeration box 22, and the blower 21 is then locked to the bottom part of the upper cover, or the blower 21 and refrigeration box 22 are respectively locked to the bottom part of the upper cover 202. Furthermore, the upper cover 202 is installed on the bottom part of the table top 11. It can be clearly seen that the components mentioned above are simple in structure, convenient in operation and good in installment stability.

The housing is opened with a housing air inlet 203 and housing air outlet 204, the blower 21 has a blower air inlet 2111 and blower air outlet 211, and refrigeration box 22 is opened with a refrigeration air inlet 221 and refrigeration air outlet 222, with the inside of the refrigeration box 22 being configured with refrigeration components, where the refrigeration air inlet 221 is in communication with the housing air inlet 203, the refrigeration air inlet 221 faces and is in communication with the blower air outlet 211, and the refrigeration air outlet 222 faces and is in communication with the housing air outlet 204; the housing air outlet 204 is preferably opened on each of the four side faces of the housing (here, equivalent to the four side faces of the bottom case 201), and the housing air outlets 204 also preferably correspond to the side faces of the main body 10 (here, may refer to one, two or more of the four side faces) to blow out cool wind or natural wind. Because the refrigeration air inlet 221 faces and is in communication with the blower air outlet 211 and the refrigeration air outlet 222 the housing air outlet 204, components such as an air fan, air pipe can be eliminated, saving design space. Considering the smoothness of air flow guiding, it is preferable to arrange the blower air outlet 211, refrigeration air inlet 221, refrigeration air outlet 222 and housing air outlet 204 in sequence in a lime. In the embodiment, these air inlets and outlets are arranged in sequence from back to front, namely, the blower air outlet 211 is opened on the front side face of the blower 21, the refrigeration air inlet 221 the rear side face of the refrigeration box 22, refrigeration air outlet 222 the front side face of the refrigeration box 22, and the housing air outlet 204 the front side face of the housing (here, the front side face of the main body 10 is opened with a window seat 13, and the housing air outlet 204 is just exactly positioned on the window seat 13 after the refrigeration device 20 is installed on the main body 10). Thus, cold wind or natural wind is blown out from the front side face of the main body 10. The straight-line-typed arrangement further facilitates the compact design of the refrigeration device 20, allowing the refrigeration device to occupy smaller space on the table cabinet, and also allowing the overall structure of the cold wind table cabinet to be more compact and reasonable, thereby facilitating controlling the product cost of the cold wind table cabinet. Naturally, all the air inlets and outlets may be arranged in a 90 degree perpendicular direction or in an inclined angle; these changes can be flexible on demand, the present invention will not place any limitation thereon.

Normally, the refrigeration device 20 further includes a control board, with which the blower 21 and refrigeration components are respectively connected. The surface of the main body 10 is configured with an operation panel 40 for controlling the blower 21 and refrigeration components, which is in connection with the control board, and a control switch capable of controlling the on and off of the refrigeration components is at least configured on the control board. Here, a push button adapted to switch between natural wind and cold wind in such a way that a user may get cold wind or natural wind blown from the table cabinet through the switch control according to their need. In fact, accompanying the gradually matured development of wireless remote control technologies, the control board may also be in connection with wireless transceiver modules so that a user may control the cold wind table cabinet through a remote or mobile terminal (e.g. mobile phone). No matter what kind of control manner is used, the control of the cold wind table cabinet may includes the switch between cold wind and natural wind, adjustment of wind speed, adjustment of cold wind temperature, running timing of the refrigeration device, and etc.

Figure 6:
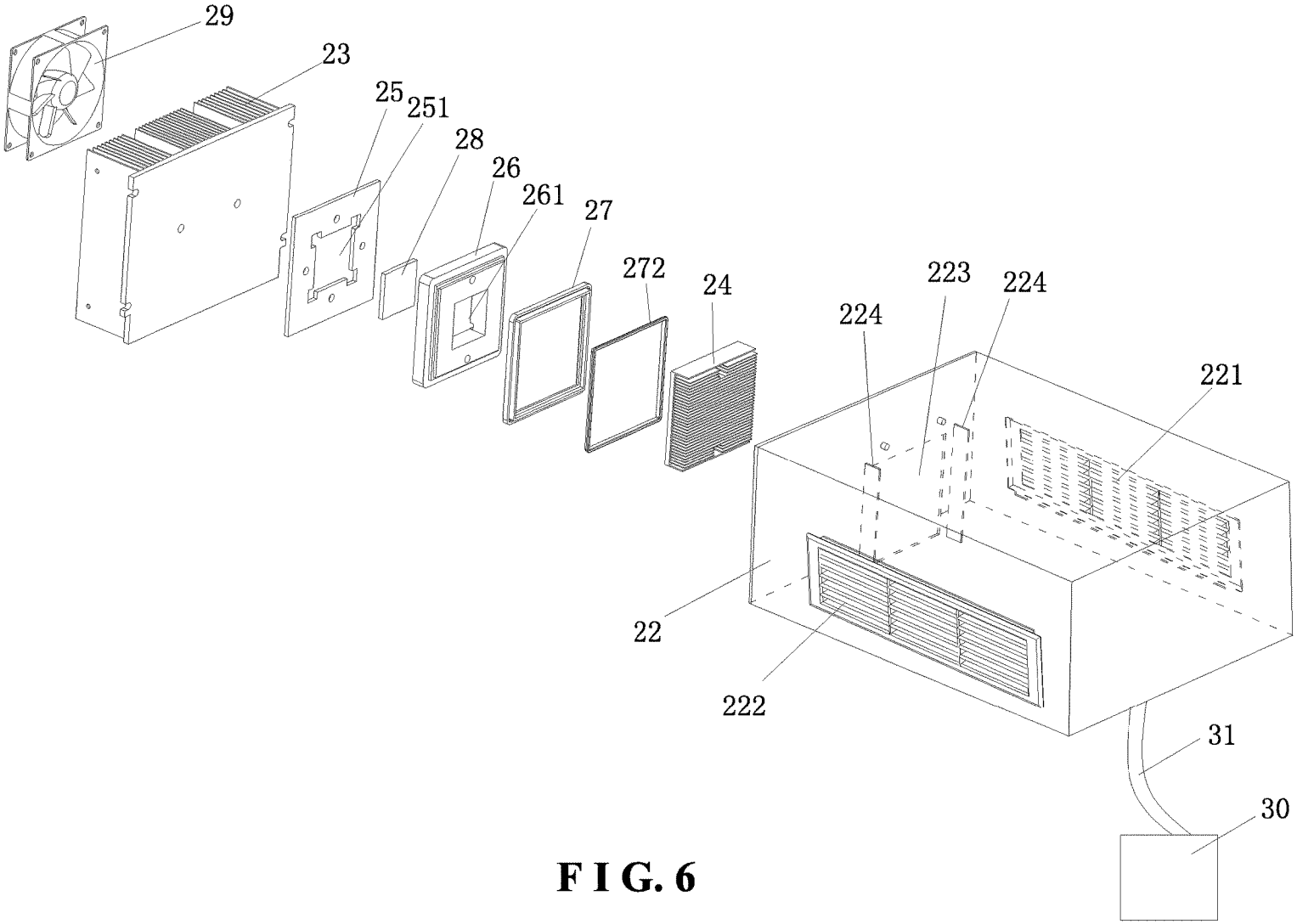
FIG. 6 is an exploded view of a refrigeration box and detailed structures of refrigeration components therein of the embodiment according to the present invention.
Figure 7:
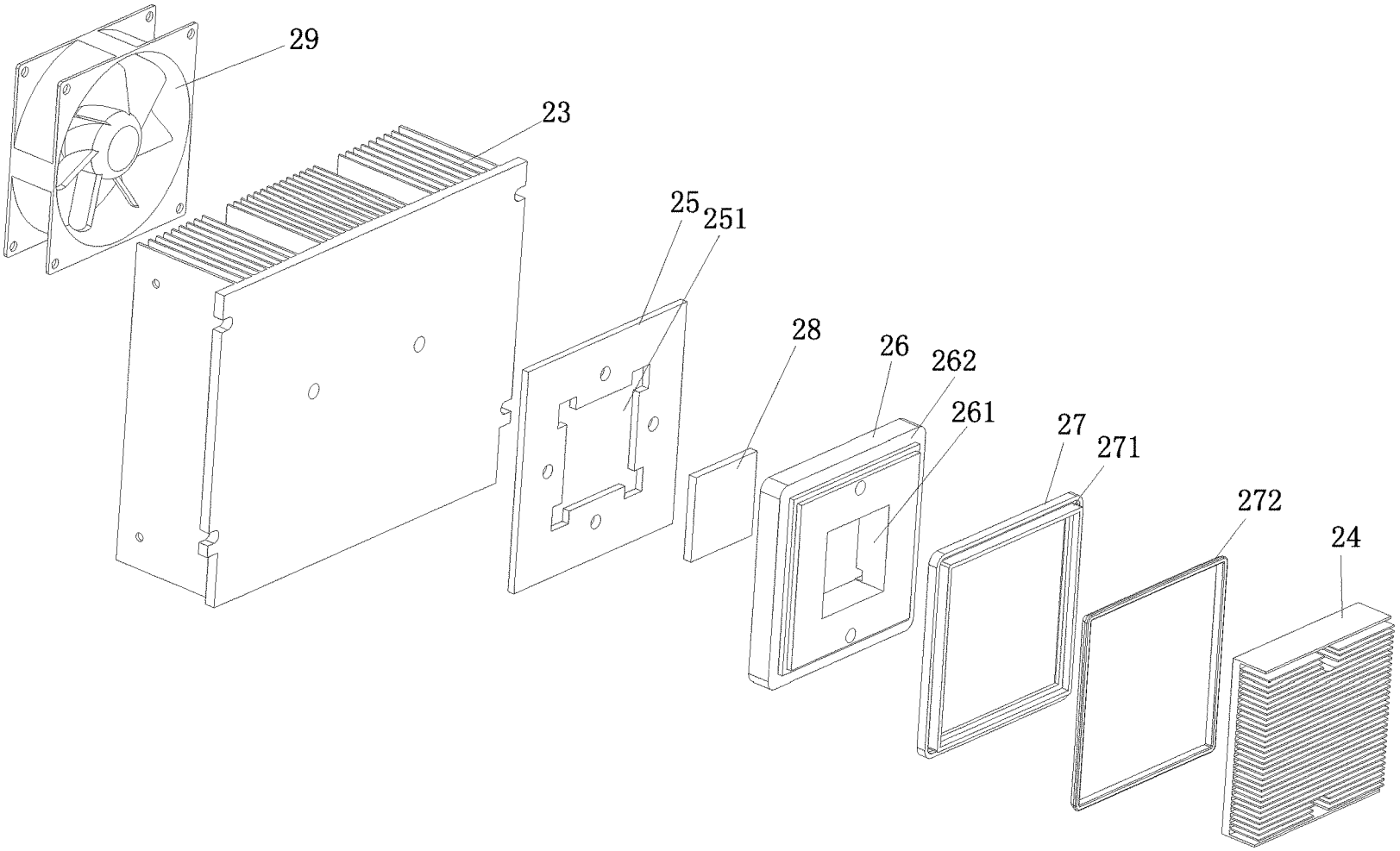
FIG. 7 is an exploded view of the detailed structures of the refrigeration components of the embodiment according to the present invention.

Referring to FIGS. 6 and 7, the refrigeration components include a refrigeration sheet 28, first cooling sheet 23 and second cooling sheet 24, where the refrigeration sheet 28 has a cooling surface and heating surface, where the first cooling sheet 23 is in contact with the heating surface, and the second cooling sheet 24 the cooling surface. In addition, the first cooling sheet 23 is exposed to the outside of the refrigeration box 22.

Specifically, the refrigeration box 22 is opened with a mounting hole 223 for the installment of the refrigeration components; the refrigeration components are installed in the refrigeration box 22 correspondingly to the mounting hole 223. A heat insulation cotton 25, positioning piece 26, engagement sheet 27 and sealing ring 272 are installed in sequence between the first cooling sheet 23 and second cooling sheet 24, and the first cooling sheet 23 is sealed on the mounting hole 223 and locked to the refrigeration box 22. Furthermore, a cooling fan 29 blowing toward the first cooling sheet 23 is configured on the outside thereof, but it can be installed on a position such as the first cooling sheet 23 or a side surface of the refrigerant box 22; the heat insulation cotton 25 is installed on a side face of the first cooling sheet 23 facing the cooling sheet 28, the heat insulation cotton 25 is opened with a first through hole 251, and the positioning piece 26 a second through hole 261 facing exactly the first through hole 251, where the cooling sheet 281 is positioned in the first, second through holes 251, 261; a first peripheral positioning groove 262 surrounding the periphery of the second through hole 261 is indented on a side face of the positioning piece 26 facing the engagement sheet 27, the engagement sheet 27 is formed into a frame structure matching the first peripheral positioning groove 262, and in engagement with the positioning groove 262, a second peripheral positioning groove 271 is indented on a side face of the engagement sheet 27 facing the second cooling sheet 24, the sealing ring 272 is embedded in the second peripheral positioning groove 271, the second cooling sheet 24 is locked to the positioning sheet 27, and the engagement sheet 27, sealing ring 272 are sandwiched and positioned between the second cooling sheet 24 and positioning sheet 26. Furthermore, at least two limiting plate 224 opposite to each other are configured on the inner wall of the refrigerant box 22 around the mounting hole 223, where the heat insulation cotton 24, cooling sheet 28, positioning piece 26, engagement sheet 27, sealing ring 272 and second cooling sheet 24 are positioned inside the mounting hole 223 and limited between the two limiting plate 224.

Furthermore, a water container 30 may be configured on the bottom of the main body 10 selectively as needed for the collection of condensed water droplets inside the refrigeration box 22, and in communication with the inside of the cooling box 22 through an aqueduct 31. In addition, the water container 30 may be installed directly on the bottom of the bottom case 201 of the housing in such a way that the aqueduct 31 is not more needed.

To sum up, the design of the present invention is stressed in that the present invention realizes the use and refrigeration of a table cabinet by integrating the refrigeration device into the table cabinet. Upon use, cold wind (or natural wind formed when the refrigeration device is turned off) is blown out form the housing air outlet, allowing a user to feel cool air flow. In addition, the operation is convenient, the mobility is good, and it can be flexibly applied to a variety of occasions. Especially, it can be used effectively four seasons a year without needing to be left unused to occupy effective use indoor space. Therefore, the present invention is very practical. More particularly, all the air inlets and outlets of the refrigeration device are specially arranged, eliminating the design of an air fan, air tube and etc, saving design space and facilitating the compact design of the refrigeration device, allowing the refrigeration device to occupy smaller space on the table cabinet and the overall structure of the cold wind table cabinet to be more compact and reasonable, thereby facilitating controlling the production cost of the cold wind table cabinet.

According to the present invention, the refrigeration box, and the structures of the design of the mutual assembly positioning relationship in the refrigeration device are rather unique, allowing the assembly to be convenient and quick, and the positioning to be stable and dependable, compact and reasonable. Especially, the configurations of the first cooling sheet, cooling fan and second cooling sheet facilitate speeding up the heat absorption of the refrigeration components and improving the cooling performance. Therefore, the present invention is good in refrigeration effect, smaller in running energy consumption and more environmentally friendly.

I claim:

1. A cold wind table cabinet, comprising a main body having a table top, a refrigeration device is configured in said main body below said table top, said refrigeration device comprising a housing, and a blower and refrigeration box installed inside said housing, a housing air inlet and housing air outlet being respectively opened on said housing, said blower having a blower air inlet and blower air outlet, a refrigeration air inlet and refrigeration air outlet being respectively opened on said refrigeration box, refrigeration components being installed inside said refrigeration box, said refrigeration air inlet being in communication with said housing air inlet, said refrigeration inlet facing and being in communication with said blower air outlet, and said refrigeration air outlet facing and being in communication with said housing air outlet; wherein said refrigeration components comprises a refrigeration sheet, and first and second cooling sheets, said refrigeration sheet has a cooling face and heating face, said first cooling sheet is in contact with said heating face, said second cooling sheet is in contact with said cooling face, and said first cooling sheet is exposed outside of said refrigeration box; wherein a mounting hole for the installment of said refrigeration components is opened on said refrigeration box, said refrigeration components are installed inside said refrigeration box correspondingly to said mounting hole; a heat insulation cotton, positioning piece, engagement sheet and sealing ring are installed in sequence between said first and second cooling sheets, said heat insulation cotton is installed on a side face of said first cooling sheet facing said refrigeration sheet, a first through hole is opened on said heat insulation cotton, a second through hole is facing exactly said first through hole and is opened on said positioning piece, said refrigeration sheet is positioned inside said first, second through holes; a first peripheral positioning groove is indented on a side face of said positioning piece facing said engagement sheet, said first peripheral positioning groove is configured around a periphery of said second through hole, said engagement sheet is a frame structure matching with said first peripheral positioning groove, said engagement sheet is engaged with said first peripheral positioning groove, a second peripheral positioning groove is indented on a side face of said engagement sheet facing said second cooling sheet, said sealing ring is embedded in said second peripheral positioning groove, said second cooling sheet is locked to said positioning piece, and said engagement sheet, sealing ring are sandwiched and positioned between said second cooling sheet and positioning piece.

2. The table cabinet according to claim 1, wherein said refrigeration device further comprises a control board, said blower and refrigeration components are respectively connected to said control board, an operation panel adapted to control said blower and refrigeration components is configured on a surface of said main body, said operation panel is in connection with said control board, and a control switch adapted to control on and off of said refrigeration components is at least configured on said control board.

3. The table cabinet according to claim 1, wherein a push button adapted to switch between natural wind and cold wind is configured on an operation panel.

4. The table cabinet according to claim 1, wherein said blower air outlet, refrigeration air inlet, refrigeration air outlet and housing air outlet are arranged in sequence along the same straight line.

5. The table cabinet according to claim 1, wherein said blower air outlet is opened on a front side face of said blower, said refrigeration air inlet is opened on a rear side face of said refrigeration box, said refrigeration air outlet is opened on a front side face of said refrigeration box, and said housing air outlet is opened on a front side face of said housing.

6. The table cabinet according to claim 1, wherein said first cooling sheet is sealed to said mounting hole and fixed on said refrigeration box, a cooling fan blowing toward said first cooling sheet is configured outside said first cooling sheet; at least two limiting plates opposite to each other are configured on an inner wall of said refrigeration box correspondingly to a periphery of said mounting hole, said heat insulation cotton, refrigeration sheet, positioning piece, engagement sheet, sealing ring and second cooling sheet are positioned inside said mounting hole and limited between said two limiting plates.

7. The table cabinet according to claim 1, further comprising a water container for the collection of condensed water droplets inside said refrigeration box, wherein said water container is installed on a bottom of said housing directly or configured on a bottom of said main body, with said water container being in communication with an inside of said refrigeration box through an aqueduct.

8. The table cabinet according to claim 1, wherein said housing comprises a bottom case and upper cover, said blower and refrigeration box are positioned inside said bottom case, said upper cover is covered on an opening of a upper end of said bottom case; said blower and refrigeration box are installed on a bottom of said upper cover or inside said bottom case of said housing, and said upper cover is installed on a bottom of said table top.

* * * * *